US006644256B2

(12) United States Patent
Takahara et al.

(10) Patent No.: US 6,644,256 B2
(45) Date of Patent: Nov. 11, 2003

(54) VALVE OPERATING SYSTEM FOR ENGINE

(75) Inventors: Naoki Takahara, Wako (JP); Toshiyuki Sato, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/308,201

(22) Filed: Dec. 3, 2002

(65) Prior Publication Data

US 2003/0131811 A1 Jul. 17, 2003

(30) Foreign Application Priority Data

Dec. 12, 2001 (JP) ..... 2001-379090

(51) Int. Cl.[7] ..... F01L 1/34

(52) U.S. Cl. ..... 123/90.16; 123/90.15; 123/193.2; 123/193.5

(58) Field of Search ..... 123/90.15–90.18, 123/90.27, 90.31, 193.2, 193.3, 193.5

(56) References Cited

U.S. PATENT DOCUMENTS 4,584,974 A * 4/1986 Aoyama et al. ..... 123/90.16
5,884,593 A * 3/1999 Immel et al. ..... 123/90.23
6,520,139 B1 * 2/2003 Kobayashi ..... 123/196 R

FOREIGN PATENT DOCUMENTS

JP 8-232623 9/1996 ..... F01L/13/00

* cited by examiner

*Primary Examiner*—Thomas Denion
*Assistant Examiner*—Kyle Riddle
(74) *Attorney, Agent, or Firm*—Arent Fox Kintner Plotkin & Kahn, PLLC

(57) ABSTRACT

A lost motion mechanism that biases a free rocker arm of a lift-amount changing member capable of lifting a valve in a direction to abut against a cam includes a spring accommodated in a support portion. The support portion is a recessed portion integrally formed on a camshaft holder below the free rocker arm. The vertical dimension of an engine is reduced as compared with a case where the support portion is provided above the free rocker arm. A camshaft cap supports the camshaft and a bolt that fastens the camshaft cap to the camshaft holder are not required.

13 Claims, 6 Drawing Sheets

VALVE OPERATING SYSTEM FOR ENGINE

BACKGROUND OF THE INVENTION

1. Field of the Invention

The present invention relates to a valve operating system for an engine including a biasing means for biasing a rocker arm and a support portion for the biasing means.

2. Description of the Related Art

There is a known valve operating system for an engine, which includes a biasing member for biasing a rocker arm to drive an intake valve or an exhaust valve of the engine toward a cam or toward the valve. In addition, a valve operating system for an engine including a lift-amount changing member that can change the lift amount of an intake valve or an exhaust valve of an engine is disclosed in Japanese Patent Application Laid-open No. 8-232623. In this type of the valve operating system for the engine, a driving rocker arm and a free rocker arm are disposed between a valve and a camshaft so the swinging movement of the free rocker arm is transmitted through the driving rocker arm to the valve by connecting the driving rocker arm and the free rocker arm to each other by a connection switchover mechanism. The swinging movement of the driving rocker arm is transmitted to the valve by disconnecting the free rocker arm from the driving rocker arm using the connection switchover mechanism. In order to prevent the free rocker arm, which is disconnected from the valve, from being moved away from the cam when the connection between both rocker arms is released, the free rocker arm is biased toward the cam by a lost motion mechanism.

The valve operating system described in Japanese Patent Application Laid-open No. 8-232623 has several drawbacks. For example, an upper surface of the camshaft supported in a camshaft holder mounted in a cylinder head is retained by a camshaft cap. Also, the lost motion mechanism is disposed above a rocker arm shaft supported above the camshaft cap. As a result, the lost motion mechanism protrudes significantly upwards, resulting in an increase in the vertical dimension of the engine. Moreover, the valve operating system includes a holder that exclusively supports the lost motion mechanism, resulting in an increase in the overall number of parts. In an attempt to avoid these drawbacks, it was believed that the lost motion mechanism could be disposed on the camshaft holder or the camshaft cap below the rocker arm shaft. However, a bolt that fastens the camshaft cap to the camshaft holder is already disposed in such a location and would result in an increase in the number of parts. Moreover, there is a problem that the degree of freedom of the design for a position where the lost motion mechanism is disposed is limited since interference between the lost motion mechanism and the bolt is to be avoided.

SUMMARY OF THE INVENTION

It is an object of the present invention to overcome the above-discussed drawbacks of the related art.

It is also an object of the present invention to reduce the number of parts of the engine, including the biasing means that biases the rocker arm and the support portion for the biasing means, as well as to reduce the vertical dimensions of the engine.

To achieve the above object, there is provided a valve operating system for an engine that includes a camshaft axially inserted into a camshaft holder formed in a cylinder head. A rocker arm is driven by the camshaft and a valve is driven by the rocker arm. The camshaft holder is integrally formed with a support portion, for a biasing member that biases the rocker arm toward the camshaft or the valve.

With the above arrangement, the support portion for the biasing member is integrally provided on the camshaft holder. Accordingly, a holder exclusive for supporting the biasing member is not required, which results in a reduction in the overall number of parts. In addition, because the camshaft is axially inserted into the camshaft holder, a camshaft cap that supports the camshaft and a bolt that fastens the camshaft cap to the camshaft holder are not required, which reduces the overall number of parts. Furthermore, the present invention also leads to an increase in degree of freedom of the design for positions where the biasing member can be disposed since there is very little possibility that the support portion for the biasing member will interfere with the bolt.

There is also provided a valve operating system for an engine that includes a camshaft axially inserted into a camshaft holder formed in a cylinder head. A valve is driven by a rocker arm. A lift-amount changing means, which is capable of changing a lift amount of the valve, includes a free rocker arm adapted to abut against a first cam, a biasing member for biasing the free rocker arm in a direction wherein the free rocker arm can abut against the first cam, a driving rocker arm adapted to abut against a second cam to drive the valve, and a connection switchover mechanism for connecting or disconnecting the free rocker arm and the driving rocker arm. The camshaft holder below the free rocker arm is integrally provided with a support portion for the biasing member.

With the above arrangement, the support portion for the biasing member is integrally provided on the camshaft holder below the free rocker arm. Hence, the vertical dimension of the engine is reduced as compared with a case where the support portion is provided above the free rocker arm. Moreover, a holder exclusive for supporting the biasing member is not required, which reduces the overall number of parts. In addition, the camshaft is axially inserted into the camshaft holder mounted in the cylinder head. Hence, a camshaft cap that supports the camshaft and a bolt that fastens the camshaft cap to the camshaft holder are not required, which decreases the overall number of parts, but also increases, in degree of freedom of the design, the overall number of positions where the biasing member can be disposed because there is very little possibility that the support portion for the biasing member will interfere with the bolt.

The support portion can also include a recessed portion formed on an upper surface of the camshaft holder.

With the above arrangement, the support portion for the biasing member includes the recessed portion formed on the upper surface and hence, a tool for processing the support portion is difficult to interfere with another member and thus, it is easy to process the support portion.

Furthermore, a side face of the support portion and a seat face for a bolt that fastens the cylinder head to a cylinder block can be connected to each other by a connecting wall.

With the above feature, the side face of the support portion for the biasing member and the seat face for the bolt for fastening the cylinder head to the cylinder block are connected to each other by the connecting wall. Hence, the rigidity of the support portion is increased, leading to an increase in support rigidity of the biasing member.

Additionally, the support portion and a rocker arm shaft support portion that supports a rocker arm shaft can be connected to each other by a connecting wall.

With the above arrangement, the support portion for the biasing member and the rocker arm shaft support portion for supporting the rocker arm shaft are connected to each other by the connecting wall. As a result, both the support portion and the rocker arm shaft support portion are effectively reinforced, leading to an increase in support rigidity of the support portion and the rocker arm shaft support portion.

It should be noted that the support portion can also include a recessed portion, a bottom of which is inclined in a direction away from the camshaft.

With the above arrangement, the bottom of the support portion for the biasing member that includes the recessed portion is inclined in a direction away from the camshaft. Accordingly, the peripheral wall of a journal support bore defined in the camshaft holder is increased, leading to an increase in support rigidity of the camshaft.

At least a portion of the recessed portion of the support portion can be formed within a width of the camshaft holder in a direction of the camshaft.

With the above arrangement, at least a portion of the support portion including the recessed portion is formed within the width of the camshaft holder in the direction of the camshaft, resulting in a reduction of the dimension of the valve operating system in the direction of the camshaft.

The intake valve for each embodiment corresponds to the valve of the present invention; a flat face for each embodiment corresponds to the rocker arm shaft support portion of the present invention; a driving intake cam and a stopping intake cam for each embodiment corresponds to the first cam and the second cam of the present invention, respectively; and a spring for each embodiment corresponds to the biasing member of the present invention.

The above and other objects, features and advantages of the invention will become apparent from the following description of the preferred embodiments taken in conjunction with the accompanying drawings.

DESCRIPTION OF THE PREFERRED EMBODIMENTS

Figure 1:
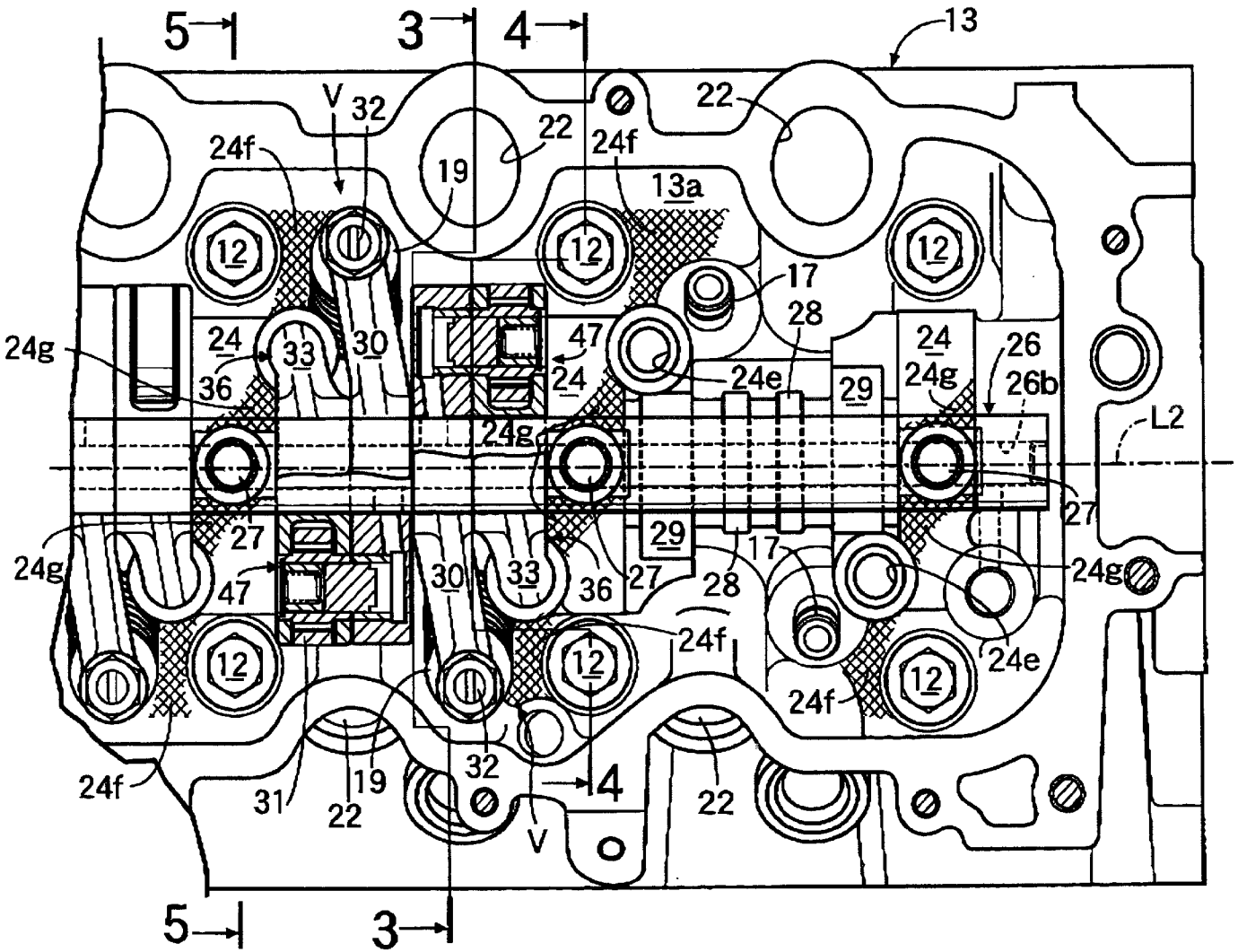
FIG. 1 is a plan view of a cylinder head portion of an engine according to a preferred embodiment of the present invention.

The preferred embodiments of the present invention are described with reference to the accompanying drawings.

An in-line multi-cylinder engine includes a cylinder head 13 coupled to an upper surface of a cylinder block 11 by a plurality of bolts 12. A combustion chamber 14 and an intake port 15 are defined in the cylinder head 13, and a stem 16*a* of an intake valve 16 that opens and closes a downstream end of the intake port 15 is slidably carried in a valve guide 17 mounted in the cylinder head 13, A valve spring 20 is disposed between a spring seat 18 provided at an upper portion of the valve guide 17 and a spring seat 19 provided at a stem end of the intake valve 16 so that an umbrella portion 16*b* of the intake valve 16 is biased by the valve spring 20 in a seating direction on the valve seat 21. A spark plug 23 is mounted in a bottom of a plug insertion tube 22 mounted on a side opposite from the intake valve 16 with a cylinder axis L1 therebetween, so the spark plug 23 faces the combustion chamber 14.

The structure of an exhaust system in the engine in the present invention is symmetric with the structure of the intake system, with respect to a cylinder-array line L2. Accordingly, only the intake system will be described below to avoid redundancy and as representative of the overall structure of the systems. Reference numerals and symbols provided to various members in the exhaust system are the same as those provided to corresponding members in the intake system.

A plurality of camshaft holders 24 are provided on an upper surface of the cylinder head 13 to protrude upwards therefrom, and a single camshaft 25 is supported by the camshaft holders 24. Each camshaft holder 24 has a one-piece structure without a cap and a journal 25*a* formed on the camshaft 25 is rotatably fitted into a circular journal support bore 24*a* defined in the camshaft holder 24. In a state in which a flat face 26*a* formed on a lower surface of a single rocker arm shaft 26 abuts a flat face 24*b* formed at a top of the camshaft holder 24, a bolt 27 that is passed from above through the rocker arm shaft 26 is fastened to the camshaft holder 24. The camshaft 25 and the rocker arm shaft 26 are disposed in parallel to each other on the cylinder axis L1.

The structure of a lift-amount changing means V for variably controlling the amount of lift of the intake valve 16 is described below.

A stopping intake cam 28, that does not have a cam lobe, and a driving intake cam 29, that does have a cam lobe, are provided adjacent each other on the camshaft 25. The stopping intake cam 28 has a diameter equal to that of a base circle of the driving intake cam 29. The cam lobe of the driving intake cam 29 has a maximum radius that is smaller than the radius of the journal support bore 24*a* in the camshaft holder 24. Thus, the camshaft 25 is inserted into the journal support bore 24*a* of each camshaft holder 24, while avoiding the interference of the stopping intake cam 28 and the driving intake cam 29 with the journal support bore 24*a* in the camshaft holder 24.

The driving rocker arm 30 is swingably supported at its intermediate portion on the rocker arm shaft 26, so that a slipper 34 mounted at one end of the driving rocker arm 30 abuts against the stopping intake cam 28 and an adjusting bolt 32 mounted at the other end abuts against the stem end of the intake valve 16. A free rocker arm 33 is swingably supported at its intermediate portion on the rocker arm shaft 26, so that a roller 31 mounted at one end of the free rocker arm 33 abuts against the driving intake cam 29 and a receiving portion 35 provided at the other end is supported on a lost motion mechanism 36.

Guide tubes 37 and 38, having the same inner diameter and coaxially arranged relative to each other, are fixed in one end of the driving rocker arm 30 and one end of the free rocker arm 33. A connecting pin 39 is slidably fitted in the guide tube 37 of the driving rocker arm 30 and a disconnecting pin 40, having the same diameter as the connecting pin 39, is slidably fitted in the guide tube 38 of the free rocker arm 33. The disconnecting pin 40 is biased toward the connecting pin 39 by a spring 42 disposed between the disconnecting pin 40 and a spring seat 41. An oil chamber 43 is defined behind the connecting pin 39 to hydraulically bias the connecting pin 39 toward the disconnecting pin 40. The oil chamber 43 communicates with an oil passage 26*b* defined within the rocker arm shaft 26 through an oil passage 30*a* defined within the driving rocker arm 30. The roller 31 is rotatably supported on an outer periphery of the guide tube 38 of the free rocker arm 33 with a needle bearing 44 interposed therebetween.

The connecting pin 39, the disconnecting pin 40, the spring 42, and the oil chamber 43 form a connection switchover mechanism 47 of the valve lift-amount changing means V.

A notch 24*d* is defined adjacent a horizontal step 24*c* on a side face of each camshaft holder 24, and the free rocker arm 33 is fitted in the notch 24*d*. in particular, a lower portion of the camshaft holder 24 is thicker while an upper portion of the camshaft holder 24 leading to the lower portion starts becoming thinner from the step 24*c*. The free rocker arm 33 is disposed in a section corresponding to the thinner notch 24*d* provided above the step 24*c*. The lost motion mechanism 36 has a support portion 24*e* that includes a tubular recessed portion integrally formed on the camshaft holder 24, a spring 45, which performs as a biasing member, fitted in the support portion 24*e* with an open upper surface, and an abutment member 46 provided at an upper end of the spring 45 to abut against the receiving portion 35 of the free rocker arm 33.

Figure 2:
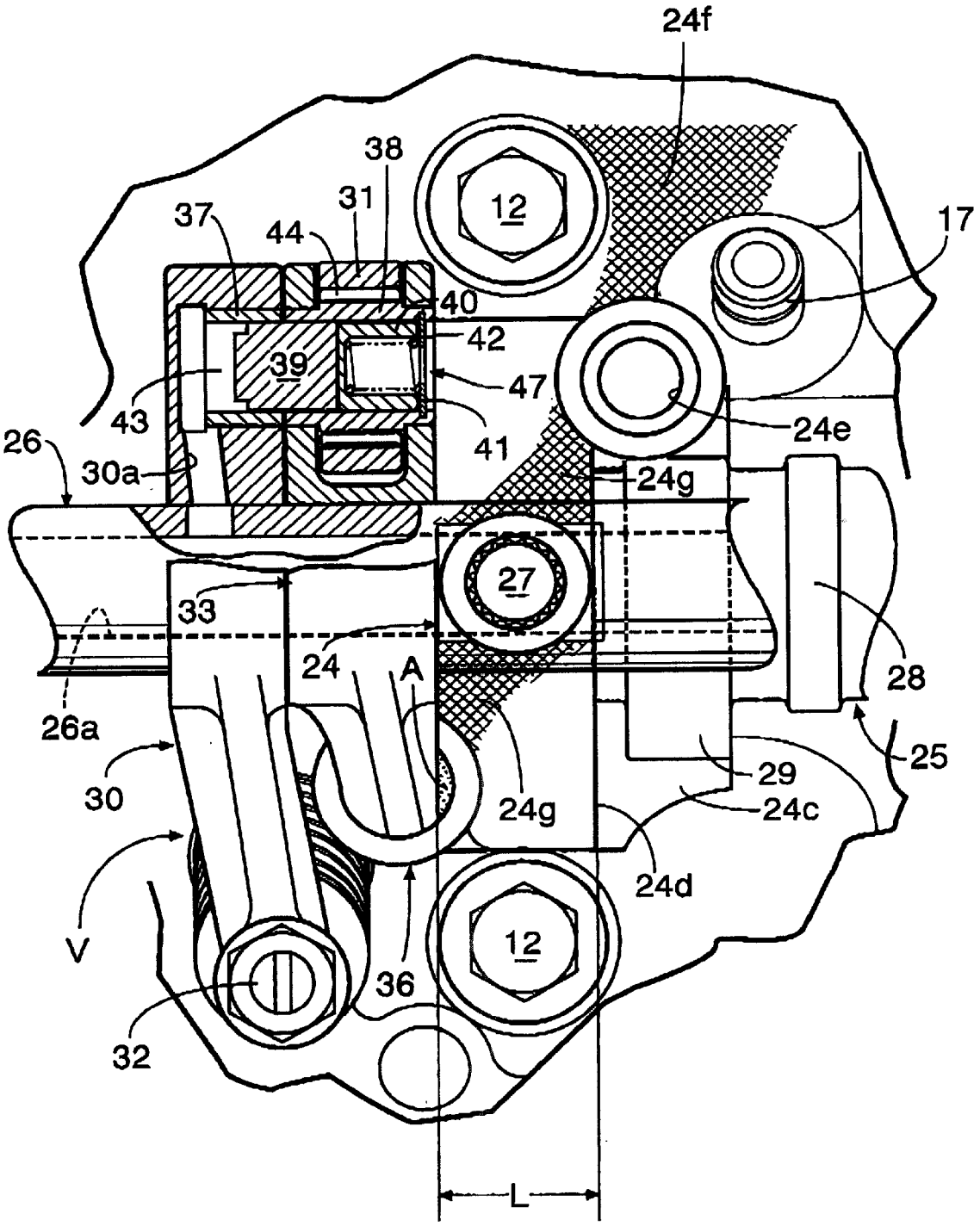
FIG. 2 is an enlarged view of a portion of FIG. 1.
Figure 3:
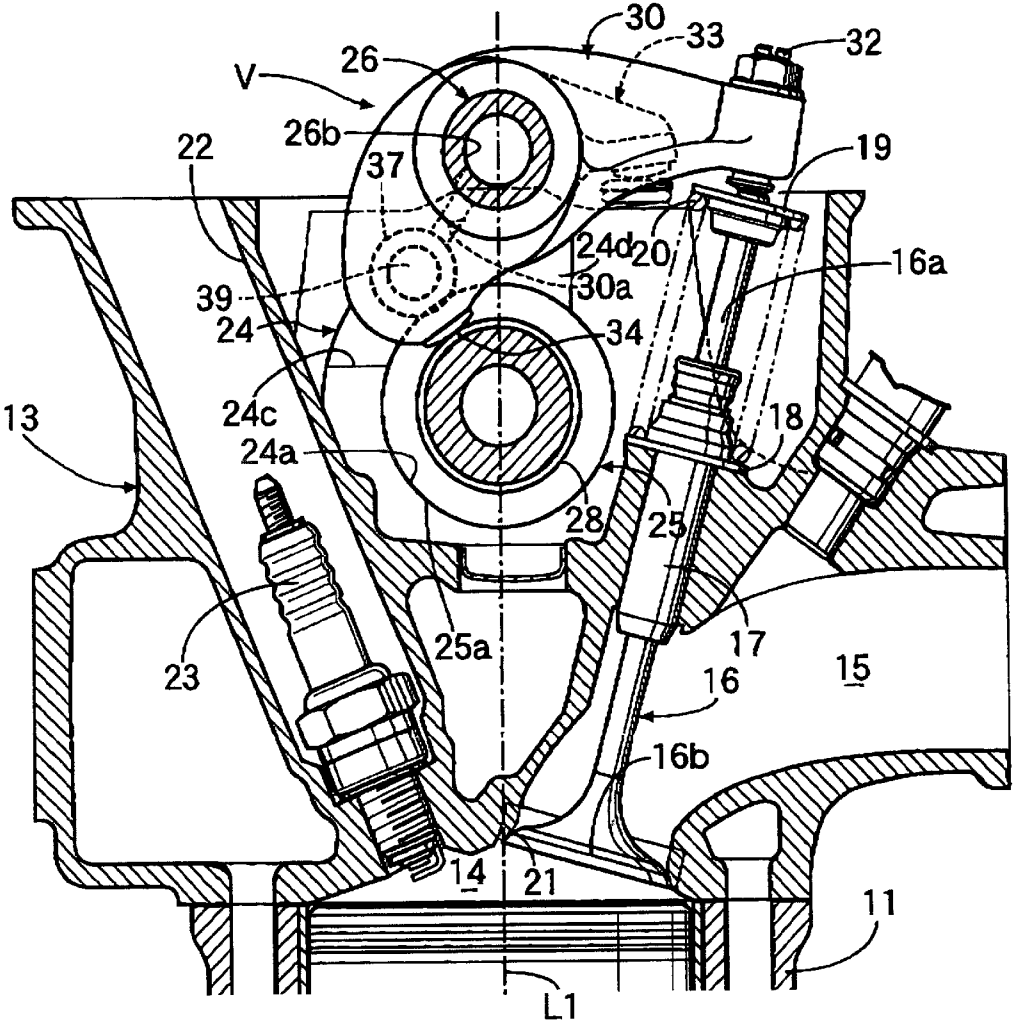
FIG. 3 is a sectional view taken along a line 3—3 in FIG. 1.

Thus, when hydraulic pressure is supplied to the oil chamber 43 through the oil passage 26*b* in the rocker arm shaft 26 and the oil passage 30*a* in the driving rocker arm 30 during acceleration or cruising of the vehicle, to push the connecting pin 39 and the disconnecting pin 40 against the spring 42, as shown in FIG. 2, the driving rocker arm 30 and the free rocker arm 33 are integrally connected to each other by the connecting pin 39. As a result, the swinging movement of the free rocker arm 33 with the roller 31 abutting against the driving intake cam 29 having the cam lobe is transmitted through the connecting pin 39 to the driving rocker arm 30 so that the intake valve 16 is opened and closed by the driving rocker arm 30. During this process, the stopping intake cam 28 is moved into and out of contact with the slipper 34 of the driving rocker arm 30 and does not function substantially.

On the other hand, when the hydraulic pressure applied to the oil chamber 43 is released during deceleration of the vehicle, the disconnecting pin 40 pushes back the connecting pin 39 by a repulsive force of the spring 42. The abutment faces of the disconnecting pin 40 and the connecting pin 39 are flush with a boundary plane between the free rocker arm 33 and the driving rocker arm 30 so that the connection between the free rocker arm 33 and the driving rocker arm 30 is released. As a result, the slip 34 of the driving arm 30 abuts the stopping intake cam 28 and the operation of the driving rocker arm 30 is stopped to retain the intake valve 16 in a closed state to prevent pumping loss. At this time, the free rocker arm 33 is swung by the driving intake cam 29, but the swinging movement of the free rocker arm 33 cannot be transmitted to the driving rocker arm 30 because the connection between the free rocker arm 33 and the driving rocker arm 30 is released. In addition, the abutment member 46 biased by the spring 45 of the lost motion mechanism 36 pushes the receiving member 35 of the free rocker arm 33 upwards, and the roller 31 is prevented from moving away from the driving intake cam 29.

Figure 4:
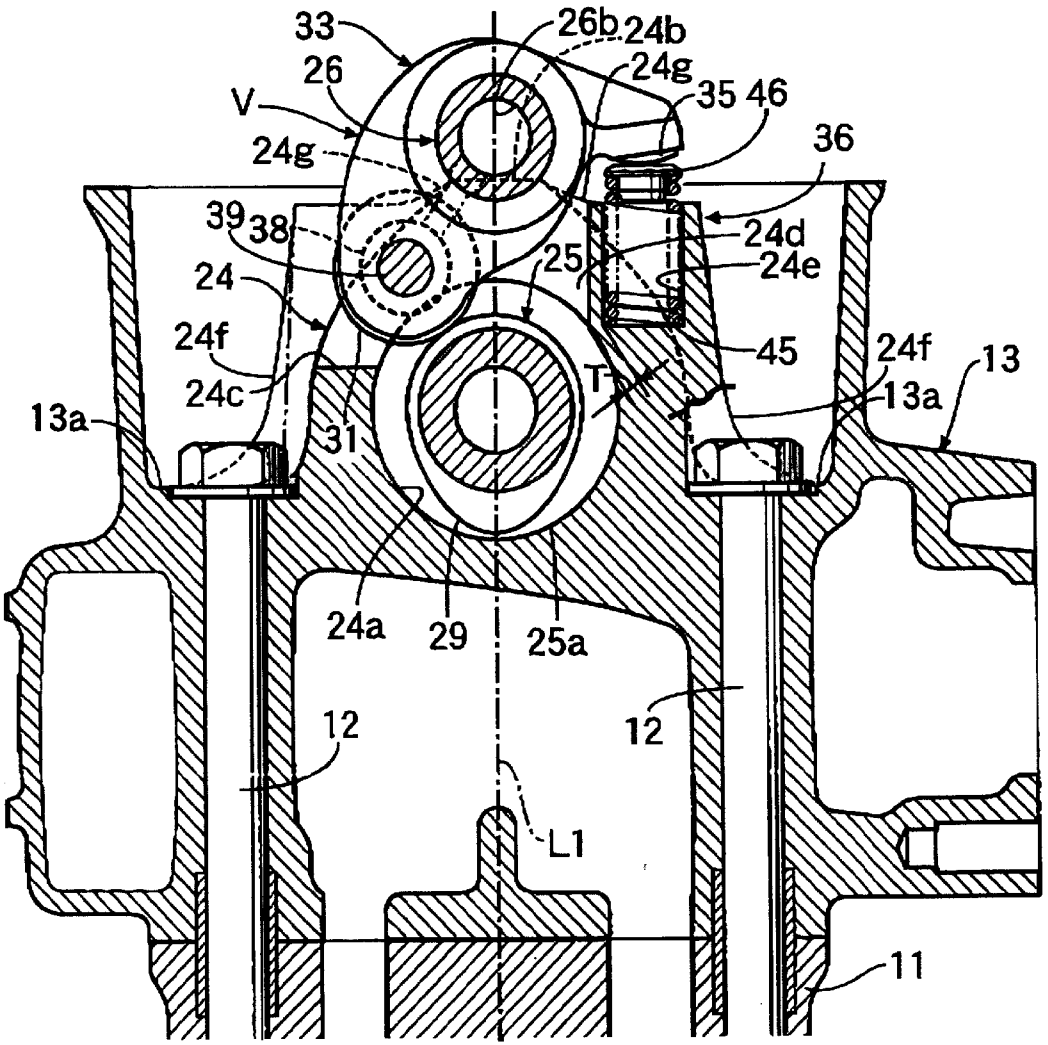
FIG. 4 is a sectional view taken along a line 4—4 in FIG. 1.
Figure 5:
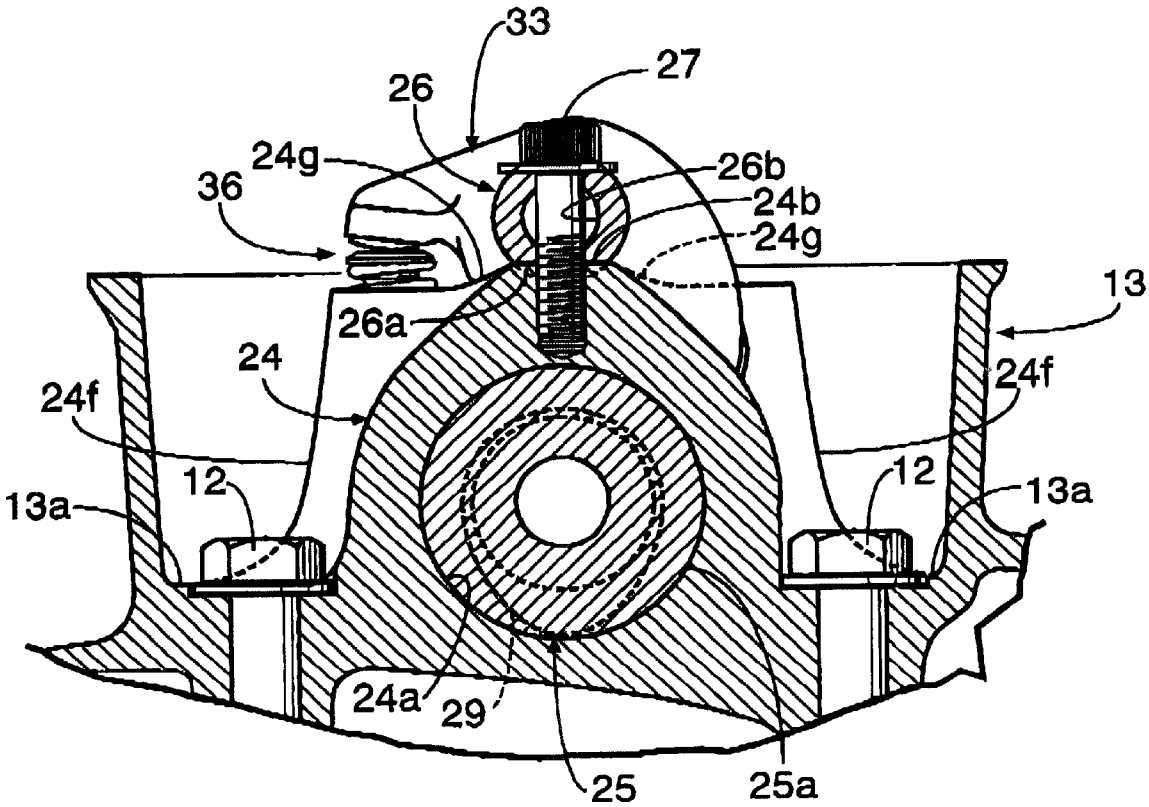
FIG. 5 is a sectional view taken along a line 5—5 in FIG. 1.

As shown in FIGS. 4 and 5, a side face of the support portion 24*e* integrally provided on the camshaft holder 24 for the spring 45 and a seat face 13*a* for the bolt 12 fastening the cylinder head 13 to the cylinder block 11 are connected to each other by a connecting wall 24*f* widened downward. The rigidity of the support portion 24*e* is thus increased by the connecting wall 24*f* to increase the support rigidity of the spring 45. In addition, a top of the support portion 24*e* of the camshaft holder 24 and the flat face 24*b* slightly higher than the top are connected to each other by a connecting wall 24*g* widened downward. The rigidity of the camshaft holder 24 and the rigidity of the support portion 24*e* are thus increased relative to each other by the connecting wall 24*g*, leading to increases in support rigidities of the spring 45 and the rocker arm shaft 26. The connecting walls 24*f* and 24*g* are shown by meshes in FIGS. 1 and 2.

Since the support portion 24*e* for accommodation of the spring 34 of the lost motion mechanism 36 is disposed below the free rocker arm 33, as described above, the vertical dimension of the engine is reduced relative to the case where the support portion 24*e* is disposed above the free rocker arm 33. In addition, since the support portion 24*e* is integrally provided on the camshaft holder 24, the number of parts is reduced relative to the case where the support portion 24*e* is formed by a separate member. Further, the camshaft 25 is inserted axially into and supported in the journal support bore 24*a* in the camshaft holder 24 mounted in the cylinder head 13 without use of a camshaft cap for supporting the camshaft 25 on the camshaft holder 24 or a bolt for fastening the camshaft cap to the camshaft holder. That is, a camshaft cap or a bolt are not required, leading to a reduction in the overall number of parts, but also leading to an increase in degree of freedom of the design for a suitable position where the lost motion mechanism 36 is disposed because there is no possibility that the support portion 24*e* for the spring 45 interferes with such a bolt. Moreover, the support portion 24*e* opens into the upper surface of the camshaft holder 24. Accordingly, a tool for processing the support portion 24*e* cannot interfere with another portion of the cylinder head 13 and thus, it is easy to process the support portion 24*e*.

As can be seen from FIG. 2, at least a portion of the support portion (see reference symbol A) is formed within a width L of the camshaft holder 24 in a direction of the camshaft 25, i.e., the support portion 24*e* is formed within a bearing width of the camshaft 25. Hence, the dimension of the valve operating system in the direction of the camshaft 25 is reduced.

Figure 6:
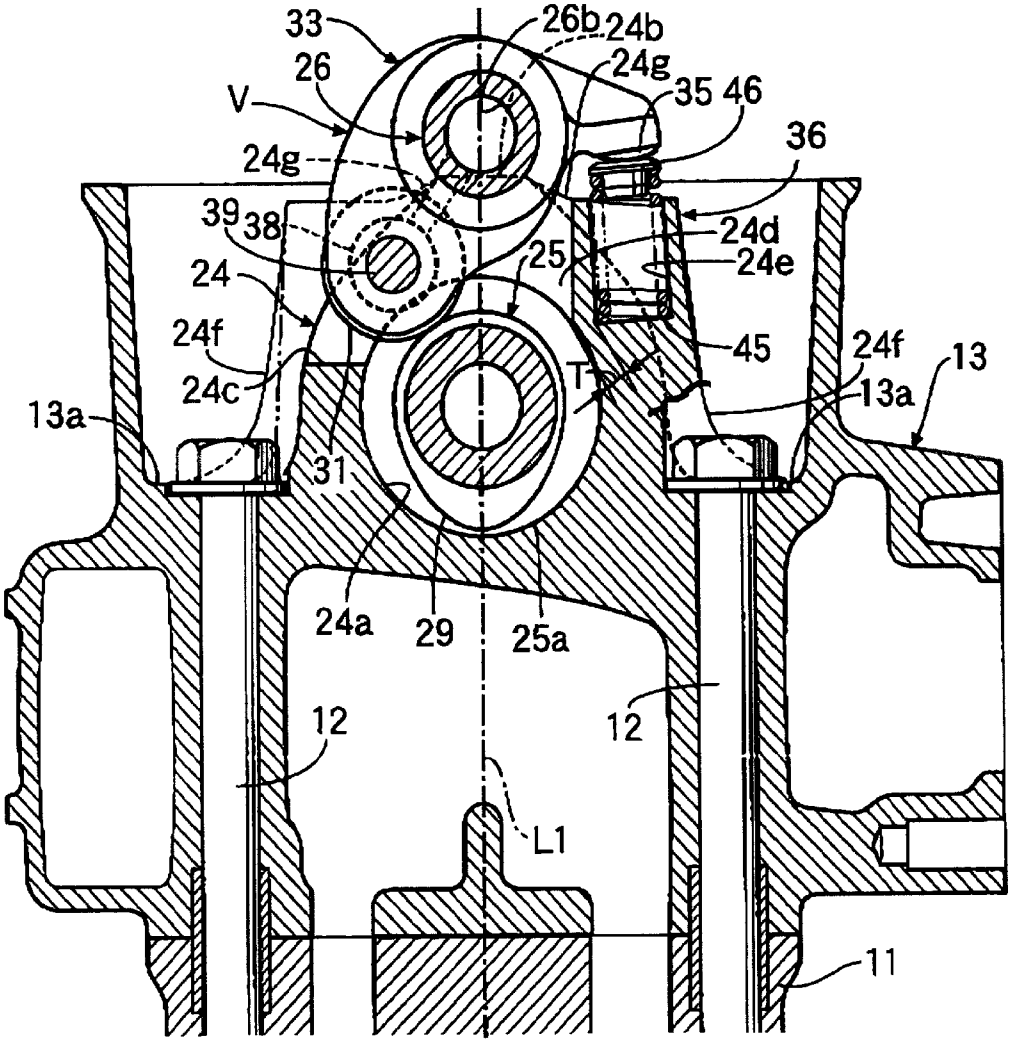
FIG. 6 is a sectional view similar to FIG. 4, but according to another embodiment of the present invention.

Another embodiment of the present invention is described with reference to FIG. 6.

In the preferred embodiment, the axis of the support portion 24*e* of the lost motion mechanism 36 is formed in parallel to the cylinder axis L1, but in this embodiment a lower portion of an axis of a support portion 24*e* is inclined in a direction away from the cylinder axis L1, namely, in a direction away from the camshaft 25. As a result, a wall thickness T between a bottom of the support portion 24*e* and a journal support bore 24*a* in the camshaft holder 24 is larger than that in the first embodiment (see FIG. 4). Thus, the rigidity of an outer peripheral wall of the journal support bore 24*a* is increased.

Although the embodiments of the present invention have been described in detail, it will be understood that the present invention is not limited to the above-described embodiments, and various modifications in design may be made without departing from the spirit and scope of the invention defined in the claims.

For example, the lift-amount changing means V in each embodiment switches over the valve between an operative state and a stopped state (i.e., lift amount=0), but may be adapted to switch over the lift amount at a plurality of stages.

In addition, in the discussed embodiments, both the intake valve and the exhaust valve have the lift-amount changing means V, but only one of the intake valve and the exhaust valve may have the lift-amount changing means V.

The present invention is also applicable to a valve operating system including no lift-amount changing means V, and the valve operating system may be one including a biasing member for biasing a rocker arm for driving the intake valve or the exhaust valve of the engine toward the cam or toward the valve.

Further, the lift-amount changing means V in the embodiments is operated to connect the free rocker arm 33 and the driving rocker arm 30 to each other by applying the hydraulic pressure to the oil chamber 43, to provide an all-cylinder operation state; and operated to disconnect the free rocker arm 33 and the driving rocker arm 30 from each other with the repulsive force of the spring 42 by withdrawing the hydraulic pressure from the oil chamber 43 to provide a cylinder-stopped state. However, the relationship between the operational states of the lift-amount changing means V may be reversed. With such arrangement, when a hydraulic system breaks down and a hydraulic pressure is not applied to the oil chamber, the free rocker arm 33 and the driving rocker arm 30 can be connected to each other to provide the all-cylinder operation state, whereby the operation of the engine can be continued without any problem.

What is claimed is:

1. A valve operating system for an engine, comprising:

a camshaft axially inserted into a camshaft holder formed in a cylinder head;

a rocker arm driven by said camshaft; and a valve driven by said rocker arm, wherein said camshaft holder is integrally formed with a biasing member support portion to bias said rocker arm toward said camshaft or toward said valve.

2. A valve operating system for an engine according to claim 1, wherein said support portion comprises a recessed portion formed on an upper surface of said camshaft holder.

3. A valve operating system for an engine according to claim 1, wherein a connecting wall connects a side face of said support portion and a seat face of a bolt that fastens the cylinder head to a cylinder block.

4. A valve operating system for an engine according to claim 1, wherein a connecting wall connects said support portion and a rocker arm shaft support portion that supports a rocker arm shaft.

5. A valve operating system for an engine according to claim 2, wherein said recessed portion of said support portion comprises a bottom that is inclined in a direction away from said camshaft.

6. A valve operating system for an engine according to claim 1, wherein at least a portion of a recessed portion of said support portion is formed within a width of said camshaft holder in an axial direction of said camshaft.

7. A valve operating system for an engine, comprising:

a camshaft axially inserted into a camshaft holder formed in a cylinder head;

a valve driven by said camshaft; and a lift-amount changing means for changing a lift amount of said valve, wherein said lift-amount changing means includes a free rocker arm adapted to abut against a first cam, a biasing member that biases said free rocker arm in a direction to abut against said first cam, a driving rocker arm adapted to abut against a second cam to drive said valve, and a connection switchover mechanism for connecting or disconnecting said free rocker arm and said driving rocker arm, and wherein said camshaft holder, below said free rocker arm, is integrally provided with a biasing member support portion.

8. A valve operating system for an engine according to claim 7, wherein said support portion comprises a recessed portion formed on an upper surface of said camshaft holder.

9. A valve operating system for an engine according to claim 7, wherein a connecting wall connects a side face of said support portion and a seat face of a bolt that fastens the cylinder head to a cylinder block.

10. A valve operating system for an engine according to claim 7, wherein a connecting wall connects said support portion and a rocker arm shaft support portion that supports a rocker arm shaft.

11. A valve operating system for an engine according to claim 8, wherein said recessed portion of said support portion comprises a bottom that is inclined in a direction away from said camshaft.

12. A valve operating system for an engine according to claim 7, wherein at least a portion of a recessed portion of said support portion is formed within a width of said camshaft holder in an axial direction of said camshaft.

13. A valve operating system for an engine according to claim 7, wherein said first cam is a stopping cam having no cam lobe.

* * * * *